US006305961B1

(12) United States Patent
Szilagyi et al.

(10) Patent No.: US 6,305,961 B1
(45) Date of Patent: Oct. 23, 2001

(54) EMI GASKET FOR CONNECTOR ASSEMBLIES

(75) Inventors: B. Daniel Szilagyi, Naperville; Scot A. Ernst, Plainfield; Igor Grois, Northbrook, all of IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/614,758

(22) Filed: Jul. 12, 2000

(51) Int. Cl.[7] ..... H01R 13/52
(52) U.S. Cl. ..... 439/271; 439/355; 439/927
(58) Field of Search ..... 439/271, 927, 439/63, 654, 86, 88, 89, 607, 595, 744, 559, 610, 148; 277/174; 361/800, 753, 355

(56) References Cited

U.S. PATENT DOCUMENTS 4,529,257 * 7/1985 Goodman et al. ..... 439/271
4,676,575 * 6/1987 Delinger et al. ..... 439/271
4,921,437 * 5/1990 Cooper et al. ..... 439/275
4,940,420 * 7/1990 Munie ..... 439/272
4,975,065 * 12/1990 Rosenberg et al. ..... 439/63
5,947,776 * 9/1999 Epe ..... 439/752
5,964,621 * 10/1999 Wolla ..... 439/595
6,166,919 * 12/2000 Nicolici et al. ..... 361/800

* cited by examiner

*Primary Examiner*—Neil Abrams
*Assistant Examiner*—J. F. Duverne
(74) *Attorney, Agent, or Firm*—A. A. Tirva

(57) ABSTRACT

An EMI gasket is provided for installing about a generally rectangular mating plug portion of a connector defined by opposite minor sides and opposite major sides. The gasket is generally rectangular to define opposite minor sides and opposite major sides thereof corresponding to the minor and major sides, respectively, of the mating plug portion. The EMI gasket, in an unstressed condition, has a generally bow-tie configuration with the major sides thereof bowed inwardly. Therefore, the major sides of the gasket are biased against the major sides of the plug portion when the gasket is installed on the plug portion.

4 Claims, 4 Drawing Sheets

EMI GASKET FOR CONNECTOR ASSEMBLIES

FIELD OF THE INVENTION

This invention generally relates to the art of connector assemblies, such as fiber optic connector assemblies, electrical connector assemblies and the like, and particularly to an EMI gasket for such connector assemblies.

BACKGROUND OF THE INVENTION

A connector assembly, such as a fiber optic connector assembly or an electrical connector assembly, typically includes a pair of mating connectors, such as plug and receptacle connectors sometimes called male and female connectors, or other types of mating devices which may include adapters for mounting connectors through a panel, backplane or the like. Regardless of the connector configuration, the connectors or connecting devices typically include some form of plug portion of one connector or connecting device inserted into a receptacle portion of a mating connector or connecting device. The plug portion and receptacle portion, therefore, define a connecting interface of the connector assembly.

A typical fiber optic connector, for instance, includes a ferrule which mounts and centers an optical fiber or fibers within the connector. The ferrule may be fabricated of such material as ceramic, and a ferrule holder or other housing component of the connector embraces the ferrule and may be fabricated of such material as plastic, cast metal or the like. A pair of fiber optic connectors or a connector and another optical fiber transmission device often are mated in an adapter which centers the fibers to provide low insertion losses. The adapter couples the connectors together so that their encapsulated fibers connect end-to-end. The adapter may be an in-line component or the adapter can be designed for mounting in an opening in a panel, backplane, circuit board or the like. Therefore, the adapter and a mating connector may have a plug and receptacle-type interface as described above.

A problem with many connector assemblies is that there may be electromagnetic interference (EMI) leakage at the connecting interface between the plug portion and the receptacle portion of the connector assembly. In order to solve this problem, it has been known to provide EMI gaskets between the mating portions of the connector assembly to prevent the ingress and/or egress of electromagnetic interference. For instance, in circular connectors, a wave-like or sinuous circular gasket is installed around the circular plug portion which is inserted into the circular receptacle portion at the connecting interface of the circular connector. The gasket may be fabricated of conductive metal to prevent EMI leakage at the interface. However, such metal EMI gaskets cause problems when used with rectangular plug and receptacle portions of connector assemblies.

In particular, a rectangularly configured connector assembly typically includes a rectangular plug portion defined by opposite minor sides and opposite major sides. The rectangular plug portion is inserted into a generally rectangular receptacle which has corresponding opposite minor sides and opposite major sides. If an attempt is made to install a rectangular EMI gasket about the rectangular plug portion at the connecting interface, the lengths of the gasket along the major sides of the plug portion tend to bow outwardly thereof. The outwardly bowed gasket often interferes with proper mating of the connector assembly and the gasket, in fact, could be deformed if mating is forced. The present invention is directed to solving this problem by providing a unique EMI gasket for rectangularly configured connectors.

SUMMARY OF THE INVENTION

An object, therefore, of the invention is to provide a new and improved EMI gasket for connector assemblies.

Another object of the invention is to provide a connector assembly which includes the EMI gasket of the invention.

In the exemplary embodiment of the invention, an EMI gasket is provided for installing about a generally rectangular mating plug portion of a connector defined by opposite minor sides and opposite major sides. The EMI gasket is generally rectangular to define opposite minor sides and opposite major sides thereof corresponding to the minor and major sides, respectively, of the mating plug portion. The EMI gasket, in an unstressed condition, has a generally bow-tie configuration with the major sides thereof bowed inwardly. Therefore, the inwardly bowed major sides of the gasket are biased against the major sides of the mating plug portion when the gasket is installed thereof.

As disclosed herein, the EMI gasket is stamped of conductive sheet metal material. Preferably, the EMI gasket is stamped with a wave-spring or sinuous configuration circumferentially thereabout.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
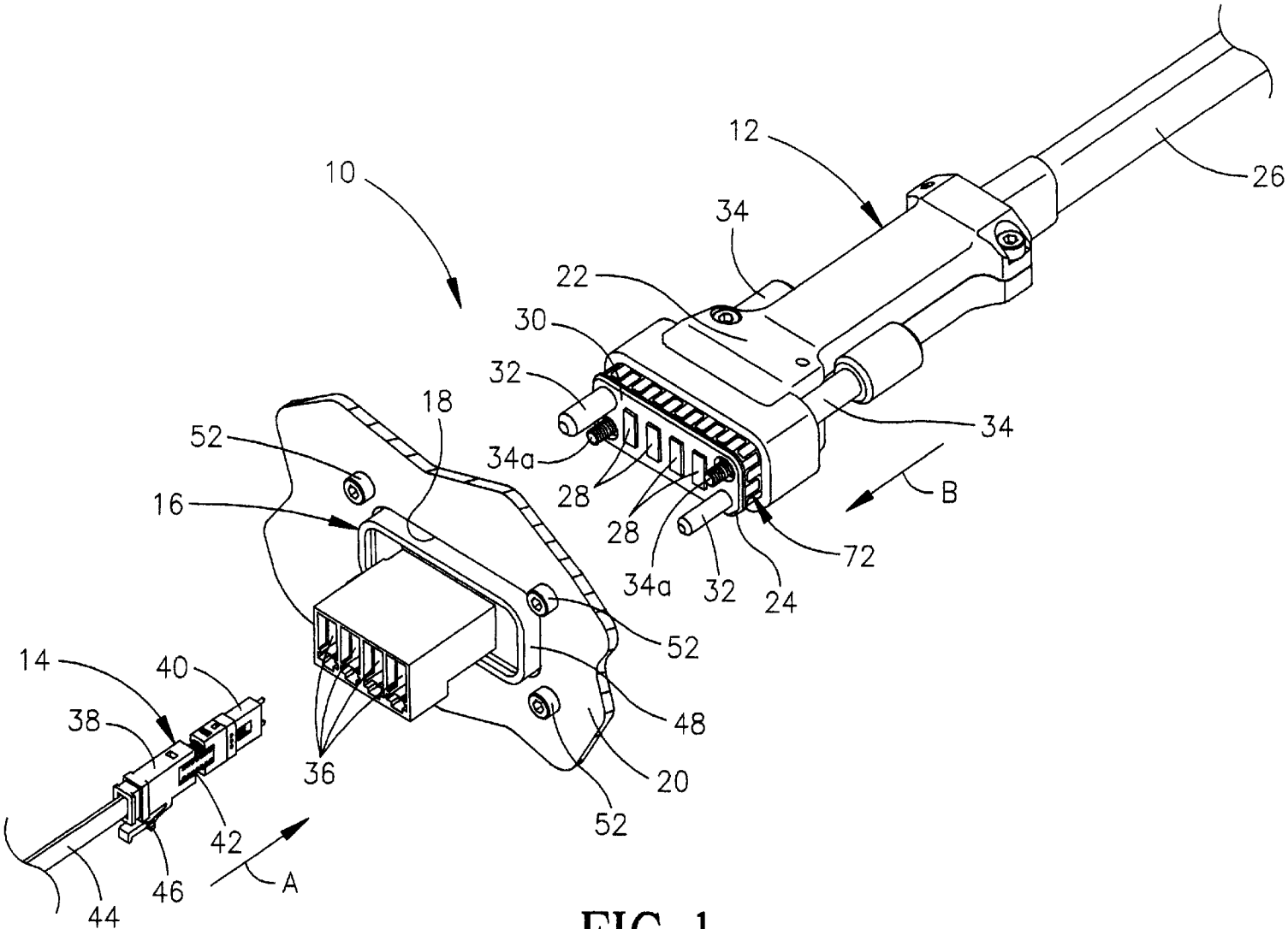
FIG. 1 is a perspective view of a connector assembly within which the invention is applicable, the assembly being in unmated condition.
Figure 2:
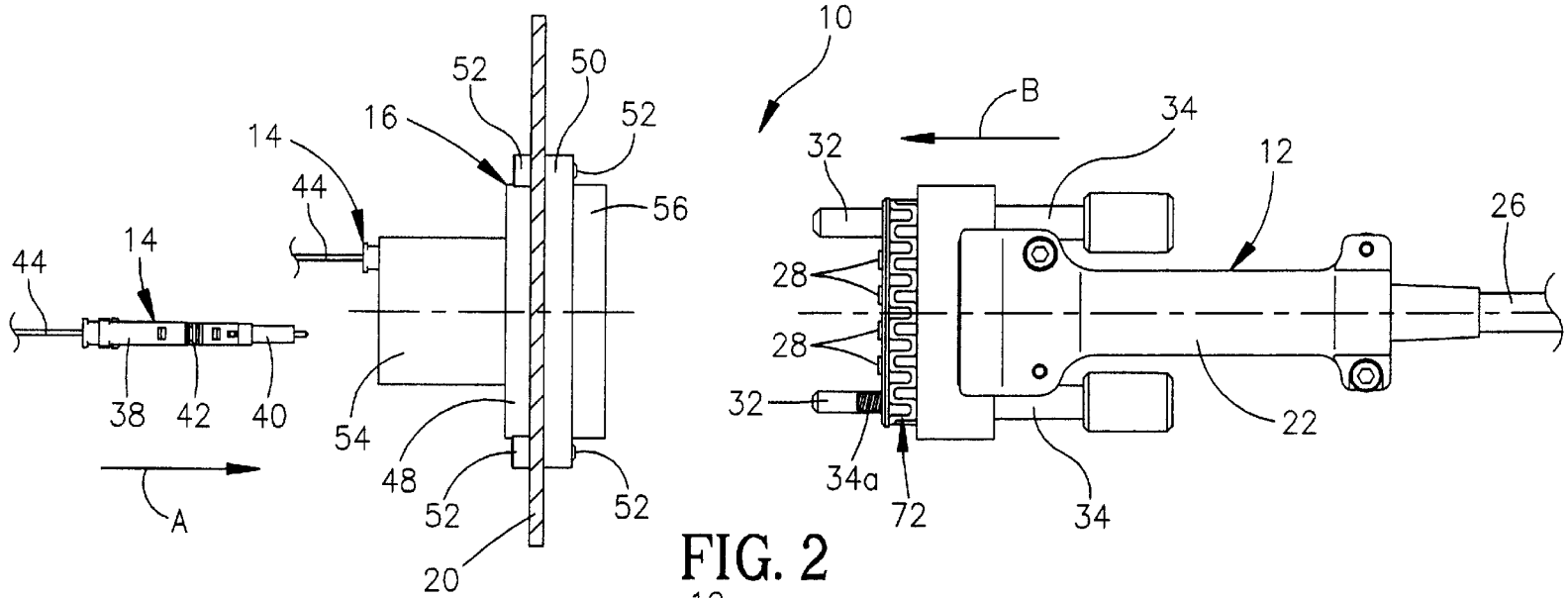
FIG. 2 is a top plan view of the connector assembly of FIG. 1.
Figure 3:
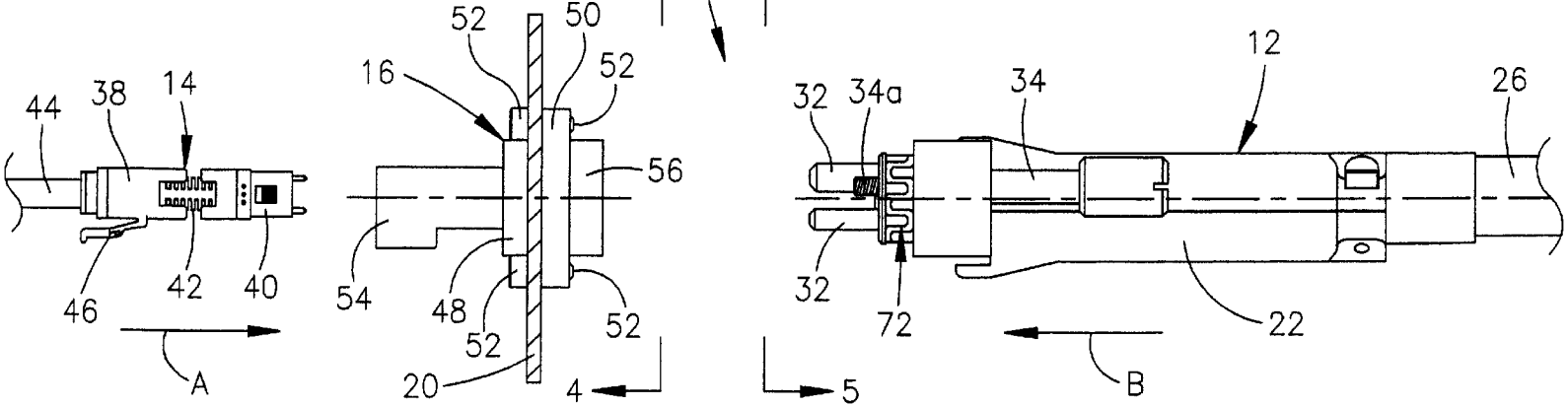
FIG. 3 is a side elevational view of the connector assembly of FIG. 1.

Referring to the drawings in greater detail, and first to FIGS. 1–3, the invention is embodied in a connector assembly, generally designated 10, which includes a fiber optic connector, generally designated 12, mateable with a plurality of fiber optic connector modules, generally designated 14, through an adapter, generally designated 16, which is mounted in an aperture 18 in a backplane or panel 20. It should be understood that, while the invention is disclosed herein in conjunction with a fiber optic connector assembly including fiber optic connector 12, the unique EMI gasket of the invention is applicable for use in a wide variety of other types of connectors.

With that understanding, fiber optic connector 12 generally includes a body 22 having a forwardly projecting mating plug portion 24. The connector terminates a fiber optic cable 26 which, itself, may include a plurality of ribbon-type cables having a plurality of optical fibers respectively terminated in a plurality of ferrules 28 (FIG. 1) projecting slightly from a front face 30 of mating plug portion 24. A pair of alignment pins 32 project forwardly of face 30 of mating plug portion 24. A pair of jack screws 34 extend through body 12 and have externally threaded shaft ends 34*a* which, like alignment pins 32, project forwardly of face 30 of mating plug portion 24.

Although only one fiber optic connector module 14 is shown in the drawings, four connector modules are inserted in the direction of arrows "A" (FIGS. 1–3) into four passages 36 at the rear of adapter 16. Each connector module 14 includes a rear body 38 joined to a front ferrule 40 by a coil spring 42. Ferrule 40 terminates a plurality of optical fibers of a ribbon-type fiber optic cable 44. A latch 46 holds the connector module in its respective passage 36 in adapter 16. When four of the connector modules are inserted and latched within the four passage 36 of adapter 16, ferrules 40 of the connector modules align with ferrules 28 of fiber optic connector 12 to interconnect the respective optical fibers when connector 12 is inserted into adapter 16 in the direction of arrows "A".

Adapter 16 includes a body portion 48 which extends through aperture 18 in panel 20. A flange 50 (FIGS. 2 and 3) is integral with body portion 48 and abuts against a front face of panel 20. Appropriate fastening means 52 extend through flange 50 to mount adapter 16 to the panel, with body portion 48 extending through aperture 18 in the panel. As stated above, passages 36 in a housing portion 54 of the adapter receive fiber optic connector modules 14. The adapter may be a one-piece structure including body portion 48, flange 50 and housing portion 54.

Figure 4:
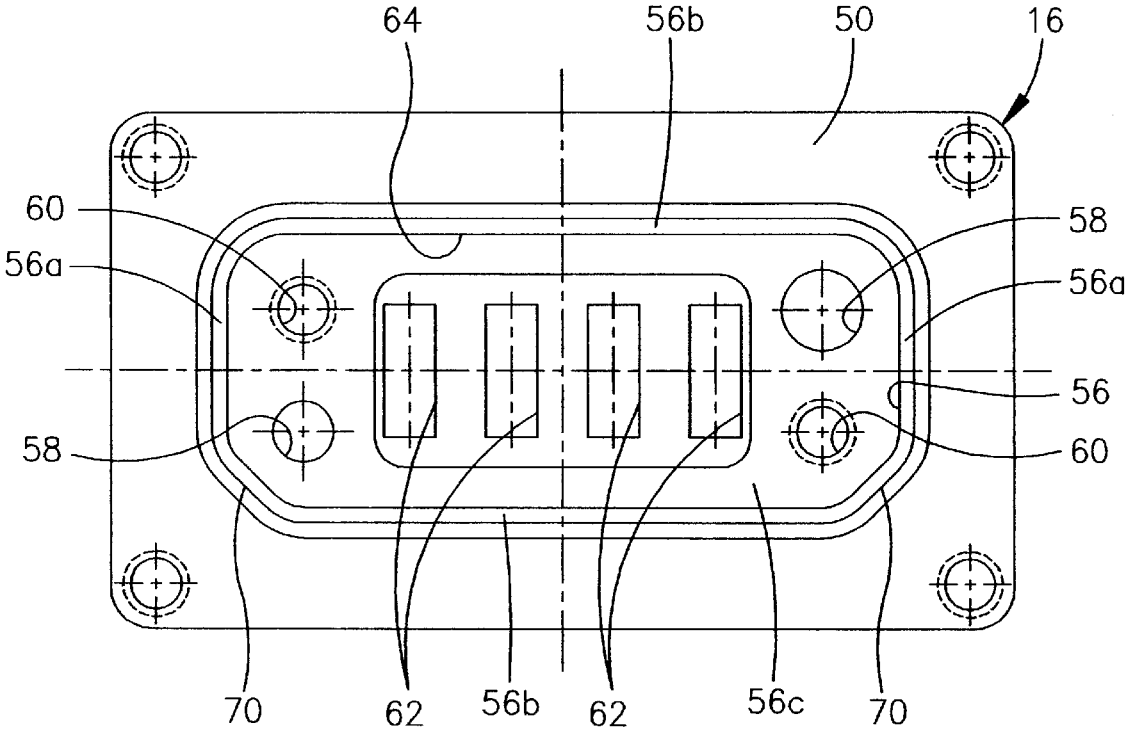
FIG. 4 is an elevational view looking generally in the direction of line 4—4 of FIG. 3.

Referring to FIG. 4 in conjunction with FIGS. 1–3, adapter 14 includes a generally rectangular receptacle 56 projecting from flange 50 in a mating direction toward connector 12 as best seen in FIGS. 2, 3 and 4. The receptacle is defined by opposite minor sides 56*a* and opposite major sides 56*b*. In other words, the minor sides are the short sides and the major sides are the long sides of the receptacle. The receptacle has a bottom or base wall 56*c* which includes a pair of alignment holes 58 for receiving alignment pins 32 of connector 12. A pair of internally threaded holes 60 receive externally threaded ends 34*a* of jack screws 34 to secure connector 12 mated to adapter 14. Four rectangular holes 62 are formed in a recessed area 64 of base wall 56*c* through which ferrules 40 of connector modules 14 project.

Figure 5:
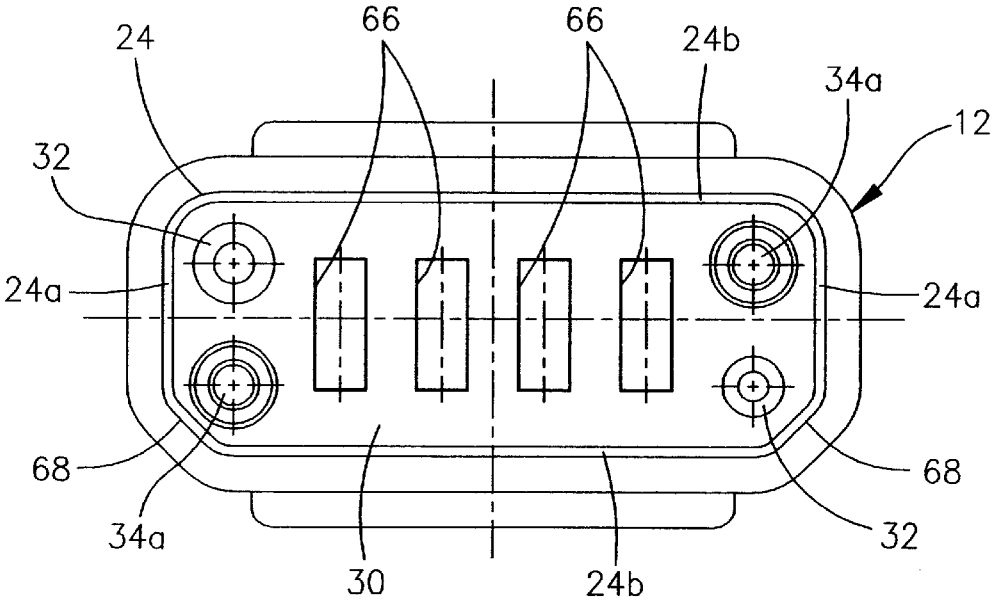
FIG. 5 is an elevational view looking generally in the direction of line 5—5 of FIG. 3.

FIG. 5 shows mating plug portion 24 of fiber optic connector 12 (FIG. 1). The plug portion is mated within receptacle 56 (FIG. 4) of adapter 14. The mating plug portion is defined by opposite minor sides 24*a* and opposite major sides 24*b*, with the plug portion configured or dimensioned for mating within receptacle 56. In other words, minor sides 24*a* and major sides 24*b* of the plug portion correspond to minor sides 56*a* and major sides 56*b*, respectively, of receptacle 56. Finally, FIG. 5 shows that face 30 of the plug portion includes four rectangular holes 66 through which ferrules 28 (FIG. 1) project.

Plug portion 24 of connector 12 includes flattened corners 68 as best seen in FIG. 5. Receptacle 56 of adapter 14 includes flattened corners 70 as best seen in FIG. 4. These flattened corners of the plug portion and the receptacle provide a polarizing means so that connector 12 can be inserted into adapter 16 in only a preferred orientation.

As best seen in FIGS. 1–3, the invention is embodied in an EMI gasket, generally designated 72, which surrounds mating plug portion 24 of connector 12. Therefore, when the plug portion is inserted into receptacle 56 of adapter 14, the EMI gasket is disposed between the plug portion and the receptacle to prevent EMI leakage at the mating interface of the connector assembly.

Figure 6:
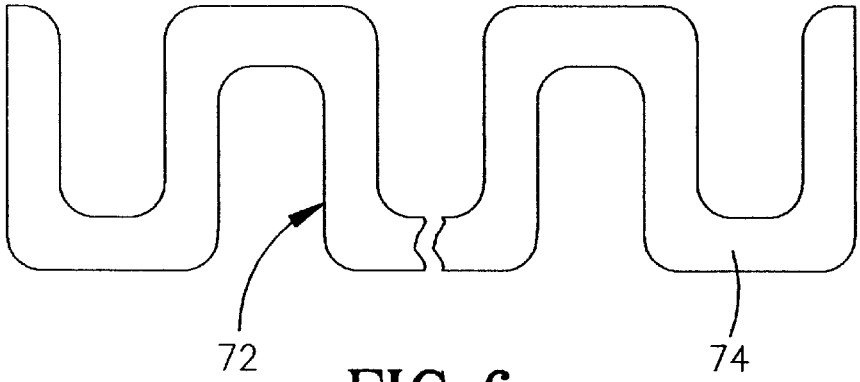
FIG. 6 is a fragmented plan view showing a flat blank for the EMI gasket after stamping.
Figure 7:
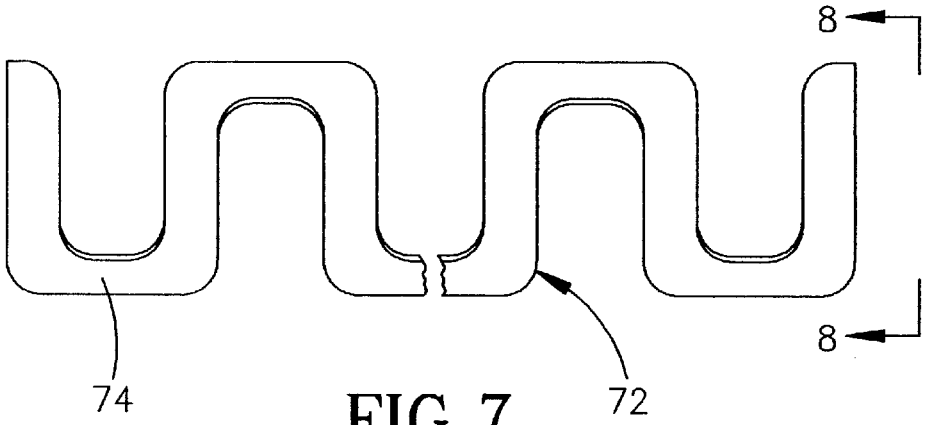
FIG. 7 is a view similar to that of FIG. 6, after the flat gasket blank has been formed.
Figure 8:
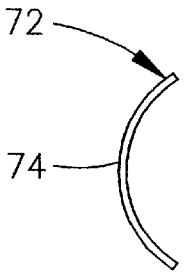
FIG. 8 is an end elevational view looking generally in the direction of line 8—8 of FIG. 7.

FIGS. 6–9 show the steps in fabricating EMI gasket 72 into its unique configuration. First, as seen in FIG. 6, a flat gasket blank 74 is stamped in a wave-like or sinuous elongated strip from conductive sheet metal material, such as a copper alloy having somewhat springy or resilient characteristics. FIG. 7 shows that gasket blank 74 then is formed into a bowed configuration in a direction transversely of the elongated strip. This transversely bowed configuration is best seen in FIG. 8.

Figure 9:
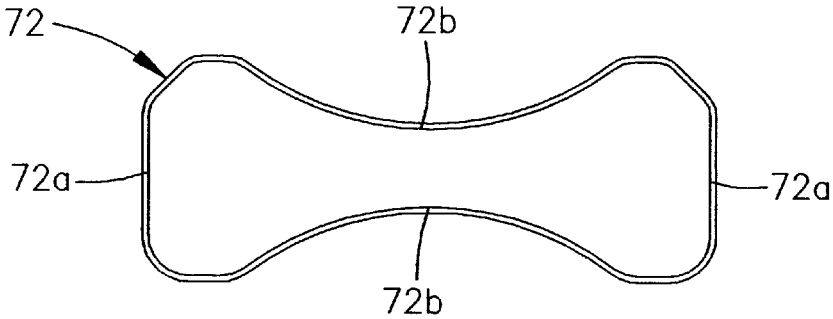
FIG. 9 is a somewhat schematic end elevational view showing the bow-tie configuration of the EMI gasket in an unstressed condition.

FIG. 9 shows EMI gasket 72 formed into its final, generally bow-tie configuration. In other words, the gasket is formed to include opposite minor sides 72*a* and opposite major sides 72*b*, with the major sides of the gasket being bowed inwardly in an unstressed condition. Minor sides 72*a* correspond to minor sides 24*a* (FIG. 5) of mating plug portion 24, and major sides 72*b* correspond to major sides 24*b* of the plug portion. When EMI gasket 72 is installed about making plug portion 24 as shown in FIGS. 1–3, major sides 72*b* of the gasket are spring biased against major sides 24*b* of the plug portion. This prevents the sides of the gasket from bowing outwardly of the plug portion and interfering with mating of connector 12 within adapter 16. As stated in the "Background", above, rectangular gaskets tend to bow outwardly and, in fact, can be deformed during mating of connecting devices. The invention solves this problem.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A connector assembly, comprising:

a connector body including a mating plug portion for insertion into a receptacle of a complementary mating connecting device, the mating plug portion being rectangular to define opposite minor sides and opposite major sides thereof; and an EMI gasket about the rectangular mating plug portion of said connector body, the EMI gasket being stamped of conductive sheet spring metal material and being rectangular to define opposite minor sides and opposite major sides thereof corresponding to the minor and major sides, respectively, of the mating plug portion, the EMI gasket in an unstressed condition having a bow-tie configuration with the major sides thereof bowed inwardly whereby the major sides of the gasket are spring biased against the major sides of the plug portion when the gasket is installed on the plug portion.

2. The connector assembly of claim 1 wherein said EMI gasket is stamped with a sinuous configuration circumferentially about the gasket.

3. An EMI gasket for installing about a rectangular mating plug portion of a connector defined by opposite minor sides and opposite major sides, the EMI gasket being rectangular to define opposite minor sides and opposite major sides thereof corresponding to the minor and major sides, respectively, of the mating plug portion, the EMI gasket being stamped of conductive sheet spring metal material, and the EMI gasket in an unstressed condition having a bow-tie configuration with the major sides thereof bowed inwardly whereby the major sides of the gasket are spring biased against the major sides of the plug portion when the gasket is installed on the plug portion.

4. The EMI gasket of claim 3 wherein the gasket is stamped with a sinuous configuration circumferentially about the gasket.

* * * * *